US009476558B2

(12) United States Patent
Stefanov et al.

(10) Patent No.: US 9,476,558 B2
(45) Date of Patent: Oct. 25, 2016

(54) PROJECTION LENS FOR USE IN AN LED MODULE FOR A MOTOR VEHICLE HEADLAMP, AND AN LED MODULE AND MOTOR VEHICLE HEADLAMP HAVING A PROJECTION LENS OF THIS TYPE

(71) Applicant: Automotive Lighting Reutlingen GmbH, Reutlingen (DE)

(72) Inventors: Emil P. Stefanov, Reutlingen (DE); Christian Buchberger, Reutlingen (DE); Markus Kiesel, Reutlingen (DE); Martin Licht, Reutlingen (DE)

(73) Assignee: Automotive Lighting Reutlingen GmbH, Reutlingen (DE)

( * ) Notice: Subject to any disclaimer, the term of this patent is extended or adjusted under 35 U.S.C. 154(b) by 253 days.

(21) Appl. No.: 14/477,429

(22) Filed: Sep. 4, 2014

(65) Prior Publication Data

US 2015/0070926 A1 Mar. 12, 2015

(30) Foreign Application Priority Data

Sep. 6, 2013 (DE) ..... 10 2013 217 843

(51) Int. Cl.
*F21S 8/10* (2006.01)
*F21W 101/10* (2006.01)
*F21Y 101/02* (2006.01)

(52) U.S. Cl.
CPC ..... *F21S 48/125* (2013.01); *F21S 48/115* (2013.01); *F21S 48/1154* (2013.01); *F21S 48/1225* (2013.01); *F21S 48/1241* (2013.01);
(Continued)

(58) Field of Classification Search
CPC ..... F21S 48/1283; F21S 48/1154; F21Y 2101/02
See application file for complete search history.

(56) References Cited

U.S. PATENT DOCUMENTS 5,772,306 A * 6/1998 Okuchi ..... F21S 48/1291 361/507
2010/0149801 A1* 6/2010 Lo ..... F21V 5/04 362/235

(Continued)

FOREIGN PATENT DOCUMENTS

DE 10 2007 012 023 A1 10/2007
DE 10 2008 030 597 A1 1/2009

(Continued)

OTHER PUBLICATIONS

Feb. 20, 2015 European Office Action for Application No. EP 14 18 0018.

*Primary Examiner* — Elmito Breval
(74) *Attorney, Agent, or Firm* — Howard & Howard Attorneys PLLC

(57) ABSTRACT

The invention relates to a projection lens for use in an LED module of a motor vehicle headlamp. The LED module has a light source in the form of an LED matrix including numerous LED chips disposed in a matrix adjacent to and/or above one another, a primary lens including numerous primary lens elements disposed in a matrix adjacent to and/or above one another for bundling light emitted from the light source, and a projection lens. The projection lens projects a light exit surface of the primary lens to generate a predefined light distribution on a surface in front of the vehicle. The projection lens is designed such that it generates at least two separate images of the light exit surface of the primary lens on its image side, which are offset to one another in the horizontal direction.

17 Claims, 11 Drawing Sheets

(52) U.S. Cl.
CPC ..... *F21S48/1258* (2013.01); *F21S 48/1283* (2013.01); *F21S 48/1317* (2013.01); *F21S 48/1335* (2013.01); *F21S 48/1747* (2013.01); *F21W 2101/10* (2013.01); *F21Y 2101/02* (2013.01)

(56) References Cited

U.S. PATENT DOCUMENTS

2010/0188018 A1* 7/2010 Salm ..... F21V 7/00 315/294
2015/0192264 A1* 7/2015 Holzl ..... F21S 48/1154 362/511
2015/0226395 A1* 8/2015 Taudt ..... F21S 48/1154 362/511

FOREIGN PATENT DOCUMENTS

| | | | |
|---|---|---|---|
| DE | 10 2008 005 488 | A1 | 7/2009 |
| DE | 10 2008 013 603 | A1 | 9/2009 |
| DE | 10 2011 077 636 | A1 | 11/2011 |
| DE | 10 2011 077 132 | A1 | 1/2012 |
| DE | 10 2010 046 626 | B4 | 5/2013 |
| EP | 2 280 215 | A2 | 2/2011 |
| EP | 2 306 073 | A2 | 4/2011 |
| EP | 2 306 074 | A2 | 4/2011 |
| EP | 2 306 075 | A2 | 4/2011 |
| EP | 2 620 695 | A2 | 7/2013 |

* cited by examiner

PROJECTION LENS FOR USE IN AN LED MODULE FOR A MOTOR VEHICLE HEADLAMP, AND AN LED MODULE AND MOTOR VEHICLE HEADLAMP HAVING A PROJECTION LENS OF THIS TYPE

CROSS-REFERENCE TO RELATED APPLICATION

This application is based upon and claims priority to German Patent Application No. DE 102013217843.3 filed on Sep. 6, 2013.

BACKGROUND OF THE INVENTION

1. Field of the invention

The present invention relates, generally, to motor vehicle headlamps and, more specifically, to a projection lens for use in an LED module of a motor vehicle headlamp 2. Description of he Related Art Motor vehicle headlamps are well known in the related art. Conventional headlamps may include a light source in the form of an LED matrix, including numerous LED chips disposed in a matrix, adjacent to and/or above one another (also referred to as matrix headlamps). The LED matrix may include a single row or column having numerous LED chips, or of numerous rows or columns disposed above or adjacent to one another, each having numerous LED chips. Matrix headlamps generate a light distribution on a road surface in front of a motor vehicle, which has numerous sub-light distributions in the form of pixels or strips, disposed adjacent to or above one another. Each LED chip normally generates its own sub-light distribution. With a targeted activation, in particular an on/off switching or dimming of the individual LED chips of the matrix light source, it is possible to influence the shape and the intensity of the light distribution. In this way, a matrix headlamp can be used to generate an adaptive light distribution without moving parts. In particular, it is possible to generate a basic low beam light distribution having a horizontal light/dark border, a conventional low beam light distribution having an asymmetrical light/dark border, a high beam light distribution, a partial high beam light distribution in which targeted regions are removed from the light distribution where other road users have been detected, or a marker light distribution in which objects detected on the road surface in front of the vehicle are illuminated in a targeted way. Matrix headlamps are known in the prior art in different embodiments, such as in published application numbers EP2306073A2, EP2306074A2, EP2306075A2, and DE102008013603A1. Further, approaches specifically for so-called "strip-headlamps" are known in the prior art, such as in published application numbers DE102011077132A1 and DE102011077636A1, with which the generated light distribution includes numerous strip shaped sub-light distributions, disposed adjacent to one another. Approaches for designing a color-correcting projection lens for matrix headlamps are known from DE102010626B4. It is proposed in EP2280215A2 that the homogeneity and the resolution of the image be improved through the use of numerous LED modules in a headlamp. An individual projection lens (or secondary lens) is allocated to each primary lens, thereby necessitating that two light source modules, at least two primary lens modules, and at least two secondary lens modules be combined for the known headlamp. Thus, at least two light exit surfaces for each matrix headlamp are visible from the outside. A so-called "compound eye" headlamp module is obtained. The strip-shaped sub-light distributions projected onto the road surface have a relatively large angular width of at least 2° horizontally, or even significantly larger. The superimposing of wide strips of this type improves the homogeneity of the light distribution, but reduces the obtainable resolution. The known headlamp requires at least two complete light modules that are independent of one another for each headlamp, wherein each light module has an LED matrix, a primary lens and a secondary lens. Thus, a headlamp of this type includes at least two light sources, two primary lenses, and two secondary lenses. With all of the matrix headlamps known from the prior art, there is, however, the problem that there are color and intensity fluctuations in the resulting light distribution. These are caused mainly by the dispersion (a change in the refraction index for optical materials in relation to the light wavelengths) and imaging errors in the projection lens. The color fluctuations occur in particular at the edges of the individual sub-light distributions.

SUMMARY OF THE INVENTION

The present invention overcomes the disadvantages in the prior art in a matrix headlamp, or components thereof, with an LED module that has a light source in the form of an LED matrix, including numerous LED chips disposed in a matrix, adjacent to and/or above one another, a primary lens including numerous primary lens elements disposed in a matrix, adjacent to and/or above one another, for bundling light emitted from the light source, and the projection lens. The projection lens projects an exit surface of the primary lens for generating a predefined light distribution on a road surface in front of a vehicle.

The headlamp of the present invention exhibits an improved homogeneity in the resulting light distribution with a single primary lens and a single projection lens, wherein it may be visible from the outside that the light distribution exits the headlamp from a single light exit aperture, or from a single projection lens. It is proposed that the projection lens is designed such that it generates at least two separate images of the exit surface of the primary lens at its imaging side, which are offset to one another in the horizontal direction, such that a superimposing of the generated images improves homogeneity of the light distribution. In this way, it is possible to generate the desired improved and more homogenous matrix light distribution with a single visible and accessible exit aperture (so-called monocular matrix headlamp). The proposed projection lens obtains a compensation for color effects and homogeneity or intensity fluctuations up to half of a pixel width, without the need for special glass materials or plastics, and without reducing the sharpness of the image, in particular the sharpness of the edges of the pixels. Thus, because of the proposed projection lens, an improvement in the color compensation and homogeneity can be obtained in a matrix headlamp, without forfeiting the sharpness (in particular, with respect to the periodically appearing color), homogeneity, and imaging errors.

Importantly, with a single matrix-type light source having a single integral primary lens disposed upstream thereof, the emitted light distribution on the light exit surface thereof is imaged onto the road surface with a single integral projection lens such that at least two separate primary lens images occur, such that in their interaction, pixel edges and border steepnesses remain intact and the remaining periodically occurring color and homogeneity or intensity fluctuations are compensated for reciprocally. It will be appreciated that there are various possibilities for designing the projection lens of the invention such that it generates the effects described above.

In order to obtain the projection lens of the present invention, it is conceivable to vary one or more of the active optically effective surfaces of the projection lens. In particular, these surfaces can be a light entry surface, a light exit surface, and/or any other surface lying therebetween (for example, with an achromatic lens). The active optically effective surfaces of the projection lens are preferably divided and/or displaced, such that the at least two separate images of the light exit surface of the primary lens, offset to one another in the horizontal direction, are generated. Each of the generated images contributes to a portion of the joint light flow, or a portion of the intensity and the illumination level. The portion contributed by each image depends on the number of separate images generated. Thus, the portion with two images is preferably 50%, and accordingly, with three images, is 33% of the overall value of the resulting light distribution.

Advantageously, the projection lens may be designed such that the separate images of the exit surface of the primary lens are each offset to one another by a value of b/n, wherein b is a width, in particular an angular width, of a pixel formed by the imaging of a single light exit surface of a single primary lens element, and n is a number of separate images of the exit surface of the primary lens generated by the projection lens. If the projection lens is designed, by way of example, for generating two separate images of the light exit surface of the primary lens, then these two images are preferably offset to one another by half of a pixel width. Accordingly, the images of the light exit surface of the primary lens are preferably offset to one another by one third of a pixel width if the projection lens is designed for generating three separate images. In this way, a particularly homogenous light distribution can be generated.

With a single matrix-type light source having a single integral primary lens disposed upstream thereof, the exit light distribution on the light exit surface thereof is imaged onto the road surface with a single integral projection lens such that at least two separate primary lens images are obtained, such that pixel edges and border steepnesses remain intact when they interact, and the remaining periodically occurring color and homogeneity or intensity fluctuations are compensated for reciprocally. There are various possibilities for designing the projection lens in accordance with the invention, such that it generates the effect described above.

In one embodiment of the present invention, it is proposed that the projection lens have at least two separate optical axes. The separate optical axes of the projection lens preferably run in the same horizontal plane. The horizontal plane preferably includes a module axis for an LED module, which is provided by the projection lens. The module axis preferably runs from the middle of the light exit surface of the primary lens in the direction of travel. The spacing of the optical axes to one another is relatively small. It is selected such that separate images of the light exit surface of the primary lens are generated, which are offset to one another in the horizontal direction by a fraction of a pixel. The different optical axes of the projection lens cause different images of the light exit surface of the primary lens to be generated. The number of separate images generated by the projection lens corresponds to the number of separate optical axes. The images of the light exit surface of the primary lens are offset to one another so to correspond to the courses of the optical axes. Because the optical axes run in the same horizontal plane, the separate images are offset to one another only in the horizontal direction. If the optical axes were disposed in different horizontal planes, then the images would also be offset to one another vertically.

In one embodiment of the invention, it is proposed that the separate optical axes of the projection lens run parallel and at a spacing to one another. Alternatively, it is proposed that the separate optical axes of the projection lens run at an angle to one another. In this case, the optical axes of the projection lens intersect, preferably in a plane of the light exit surface of the primary lens. The plane of the light exit surface preferably runs perpendicular to the horizontal plane, in which the optical axes are disposed. It is particularly preferred that the optical axes, which run at an angle to one another, intersect the light exit surface of the primary lens at a point of intersection for the module axis.

In one embodiment of the present invention, it is proposed that at least one active optical surface of the projection lens is provided with alternating optical regions for generating substantially identical images of the exit surface of the primary lens, which are disposed adjacent to, or above, one another, wherein a first group of the optical regions generates a first image of the exit surface of the primary lens, and at least one second group of optical regions generates at least one further image of the exit surface of the primary lens, wherein the generated images are disposed offset to one another in the horizontal direction in the resulting light distribution. In this way, at least one active optical surface of the projection lens can be provided with the alternating regions as strips or a checkerboard. An individual optical axis is allocated to each group of regions, which is separate from the optical axes of the other groups of regions.

Preferably, the alternating optical regions are formed on a light exit surface of the projection lens. It is further preferred that the alternating optical regions are designed as strips, wherein the strips extend vertically. If the projection lens generates two separate images of the light exit surface of the primary lens, the strip-shaped regions preferably alternate between two groups. Accordingly, if the projection lens generates three separate images of the light exit surface of the primary lens, then each third strip-shaped region is allocated to one of three groups.

It is further proposed that the active optical surface of the projection lens is provided with numerous prisms, extending over the entire surface, disposed adjacently to one another, the longitudinal axes of which run parallel to one another, wherein one prism surface of the prisms generates the first image of the exit surface of the primary lens, and the other prism surface of the prisms generates the second image of the exit surface of the primary lens. The prism surfaces can be designed such that they are flat or curved.

In one embodiment, an apex of the prisms is flattened off over the entire length thereof, such that a roof surface of the prism is obtained, which generates a further image of the light exit surface of the primary lens, which is offset in relation to the other two images in the horizontal direction. In this way, the projection lens can thus generate three separate images of the light exit surface of the primary lens, offset to one another in the horizontal direction. The images are preferably offset to one another by b/3, wherein b is the width, in particular an angular width, of a pixel in the resulting light distribution, thus a sub-image of a sub-light exit surface of a primary lens.

Further, it is proposed that the prism surfaces of the prisms are each divided into two sub-surfaces over their entire length, wherein a contact line of the sub-surfaces of a prism surface of a prism runs parallel to the longitudinal axis of the prism, wherein the sub-surfaces each generate a separate image of the light exit surface of the primary lens, disposed such that it is offset to the other images. In this way, the projection lens can thus generate, with a prism having apexes, four separate images of the light exit surface of the primary lens, offset to one another in the horizontal direction. With a prism having a flattened off apex and a roof surface, the projection lens can generate five separate images of the light exit surface of the primary lens, offset to one another in the horizontal direction. The images are preferably offset to one another by w'/4, or w'/5 respectively, wherein w' is the width, in particular an angular width, of a pixel of the resulting light distribution, thus a sub-image of a sub-light exit surface of a primary lens element.

It will be appreciated that other structures suitable for generating the separate images of the light exit surface of the primary lens can also be provided. Furthermore, it is conceivable to superimpose the structures for generating the separate images with an arbitrary diffusion structure.

Further, it is proposed that the alternating optical regions formed on the at least one active optical surface of the projection lens have an amplitude of less than 0.1 mm, preferably less than a small number of micrometers.

It will be appreciated that an LED module according to the invention can be obtained through the use of a projection lens according to the invention in an LED module for a motor vehicle headlamp. Likewise, a headlamp according to the invention can be obtained through the use of a projection lens according to the invention in a motor vehicle headlamp.

BRIEF DESCRIPTION OF THE DRAWINGS

Other objects, features, and advantages of the present invention will be readily appreciated as the same becomes better understood after reading the subsequent description taken in connection with the accompanying drawing wherein.

DETAILED DESCRIPTION OF THE INVENTION

Figure 1:
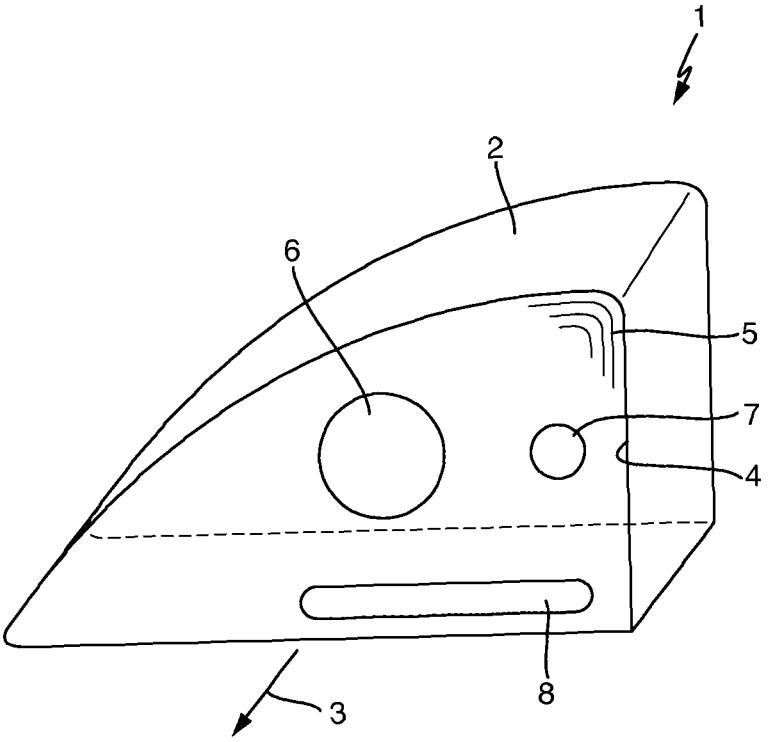
FIG. 1 shows a motor vehicle headlamp according to one embodiment of the invention.

In FIG. 1, a motor vehicle headlamp according to the invention is indicated as a whole with the reference numeral 1. The headlamp 1 has a housing 2, preferably made of plastic. The headlamp housing 2 has a light exit aperture 4 facing a light exit direction 3, which is closed with a transparent cover plate 5. The cover plate 5 may be made of glass or plastic. Optically effective profiles (for example, prisms or cylindrical lenses), at least in sections, can be disposed on the cover plate 5 in order to diffuse the light passing through it (so-called headlamp diffusers). It is also conceivable that the cover plate 5 could be designed without optically effective elements (so-called clear plates).

A light module 6 is disposed in the interior of the headlamp housing 2. The light module 6 can serve to generate an arbitrary headlamp function or a portion thereof. In particular, the light module 6 can serve to generate a low beam light distribution, a high beam light distribution, a fog light distribution, or an arbitrary adaptive light distribution. Moreover, a further light module 7 can be disposed in the housing 2. This serves, by way of example, for generating a further headlamp function. It is also conceivably that the light modules 6, 7 could collectively generate a specific headlamp function. Thus, the light module 7 could, for example, generate a low beam basic light distribution having a relatively wide diffusion and a horizontal light/dark border. The light module 6 could then generate a low beam spot light distribution, which is relatively strongly concentrated in comparison with the low beam basic light distribution from the light module 7, and has an asymmetrical light/dark border at the top. A superimposing of the basic light distribution and the spot light distribution results in a conventional low beam light distribution. It is also conceivable that further light modules could be disposed in the headlamp housing 2 in addition to the light modules 6, 7. Furthermore, it is possible for only one light module to be disposed in the headlamp housing 2, for example, the light module 6 without the light module 7. Further, it is also possible that one or more lamp modules, such as the illustrated lamp module 8, could be disposed in the housing 2. By way of non-limiting example, the lamp module 8 may serve to generate an arbitrary lamp function, such as a blinker light, a navigation light, daytime running lights, and the like.

Figure 2:
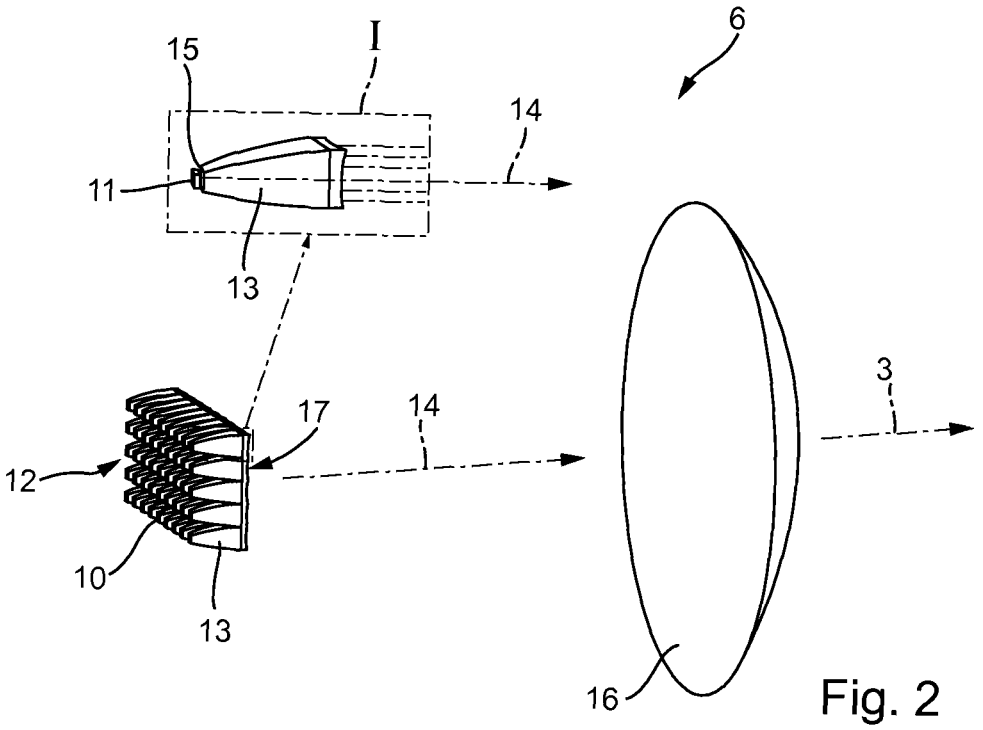
FIG. 2 shows an LED module according to one embodiment of the invention for a motor vehicle headlamp.

The light module 6 is advantageously designed as an LED module according to the present invention. The LED module 6 is shown in detail in FIG. 2. The LED module 6 has a light source in the form of an LED matrix, which is indicated generally at 10. The LED matrix 10 has numerous LED chips 11 disposed in a matrix, adjacent or next to one another. Furthermore, the LED module 6 includes a primary lens, indicated generally at 12. The primary lens 12 has numerous primary lens elements 13, disposed in a matrix, adjacent to or above one another. In the depicted example, each LED chip 11 is allocated its own primary lens element 13. As illustrated by detail I, which shows a primary lens element 13 of this type together with an LED chip 11 allocated it, the LED chip 11 emits light in a main beam direction 14, the majority of which is coupled through a light entry surface 15 in the primary lens element 13. The primary lens element 13 itself can be designed as a conventional reflector for minor reflection, or as a so-called "attachment lens element" made of a transparent material (for example, glass or plastic) for total reflection. In the depicted example, the primary lens element 13 is designed as a totally reflecting attachment lens made of a transparent plastic material. The primary lens 12 can bundle the light emitted from the LED matrix 10. Further, the LED module 6 includes a projection lens 16 designed as an optical lens. The projection lens 16 is also referred to as a secondary lens and projects an exit surface 17 of the primary lens 12 so as to generate a predefined light distribution on a road surface in front of a vehicle equipped with the headlamp 1 and the LED module 6. The projection lens 16 can be designed as a conventional optical lens or as and achromatic lens.

Figure 3:
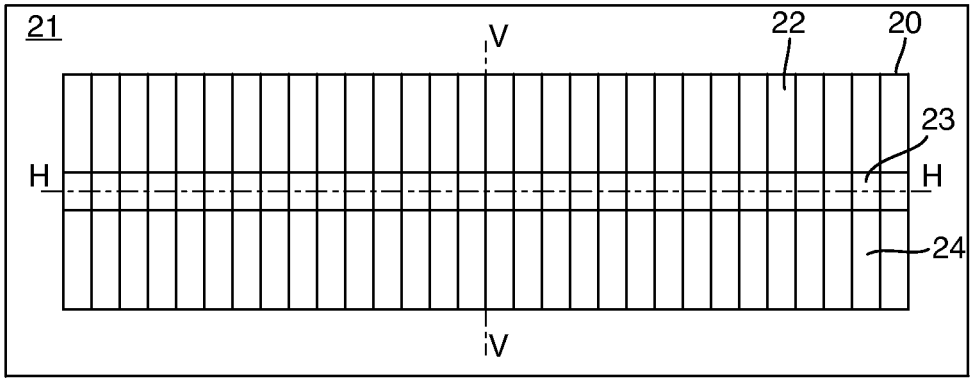
FIG. 3 shows a light distribution of a matrix headlamp known from the prior art.

The headlamp 1 with the LED module 6 is referred to as a matrix headlamp, because it generates a light distribution with numerous pixel or strip shaped sub-light distributions disposed above and/or adjacent to one another. The individual sub-light distributions generated from the light of an LED 11 and the associated primary lens element 13 are also referred to as pixels. Each of the sub-light distributions is generated by imaging a sub-light exit surface of an individual primary lens element 13 of the primary lens 12 with the projection lens 16. A light distribution for a matrix headlamp 1 known from the prior art is shown by way of example in FIG. 3. The light distribution 20 is imaged on a measurement screen 21, which is disposed at a defined spacing to the headlamp 1, or the LED module 6, respectively, in front of the motor vehicle. A horizontal axis HH and a vertical axis VV running perpendicular thereto are plotted on the measurement screen. Thus, the light distribution 20 shown here by way of example has numerous pixels 22, 23, 24 disposed adjacent to and above one another. In particular, the pixels 22, 23, 24 in the depicted embodiment example are disposed in three rows and in thirty columns. The pixels in the upper row are indicated with the reference symbol 22, the pixels in the middle row are indicated with the reference symbol 23, and the pixels in the lower row are indicated with the reference symbol 24. Each pixel 22, 23, 24 in the depicted light distribution 20 is generated with an LED chip 11 interacting with the allocated primary lens element 13, after projection through the secondary lens 16.

With a targeted activation of the individual LED chips 11 in the LED matrix 12, it is possible to vary the resulting light distribution 20 in a number of different ways. As such, it is conceivable, for example, to temporarily shut off those LED chips 11 in the pixel region of the light distribution 20 in which other road users have been detected. In this way, it is possible to drive with a continuous high beam, wherein a blinding of other road users is prevented by locally removing the pixels 22, 23, 24 from the light distribution (so-called partial high beams). Likewise, it would be conceivable that the LED module 6 generates a low beam light distribution with an asymmetrical upper light/dark border, wherein the LED chips 11 for generating the upper row of pixels 22 are shut off, except for a few LED chips 11 for generating the pixels 22 on the side of the traffic in which the vehicle is located. Furthermore, it would be conceivable to turn on individual LED chips 11 in a targeted way for illuminating objects detected on a road surface in front of the motor vehicle, in order to generate one or more pixels 22, 23 above the light/dark border of the low beam light distribution, such that the objects detected on the road surface can be illuminated in a targeted way (so-called marking light or marker light). It will be appreciated that many other adaptive light distributions 20 can be obtained with targeted on/off switching and/or dimming of the LEDs 11.

In particular, along the edge of the individual pixels 22, 23, 24, the resulting light distribution 20 may exhibit an undesired color fringe. In addition, clearly visible intensity fluctuations may occur in the light distribution 20. With the present invention, the homogeneity of the light distribution 20 with respect to disruptive color effects and intensity fluctuations is to be improved.

The present invention proposes, in particular, a special homogenizing projection lens (or secondary lens) 16 as a component of a matrix headlamp 1 for motor vehicles, in which a light exit surface 17 of the primary lens 12 includes numerous pixel or strip shaped periodic structures, aligned in rows, which are projected with the special projection lens 16 onto the road surface in order to implement a dynamic low beam, partial high beam, matrix light or high beam light function. The projection lens 16 generates at least two separate images 25, 26 (compare FIGS. 4 and 5) of the light exit surface 17 of the primary lens 12 located on the object side on the image side, i.e. on the road surface or on a measurement screen 21. By superimposing the at least two separate images 25, 26, a resulting light distribution 27 is obtained (compare with FIG. 6), wherein the at least two images 25, 26 are offset to one another in the horizontal direction in such a way that a significant improvement in the homogeneity of the light distribution 27 is obtained. In particular, undesired color effects or intensity fluctuations in the light distribution 27 are reduced in a targeted way, or even eliminated entirely. The separate images 25, 26 of the light exit surface 17 of the primary lens 12 are generated with a shared projection lens 16.

Figure 4:
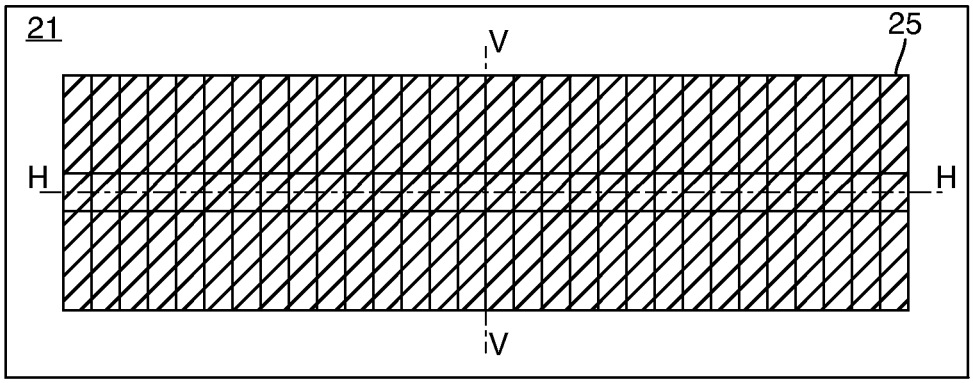
FIG. 4 shows a first image of a light exit surface of a primary lens for an LED module according to the invention.
Figure 5:
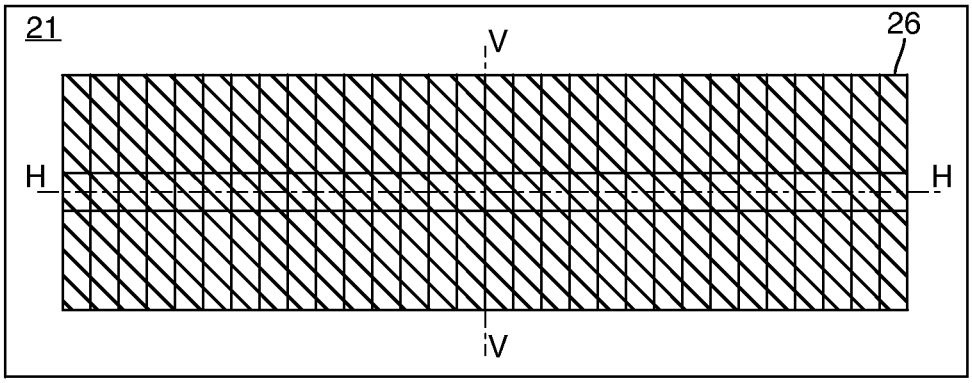
FIG. 5 shows a second image of a light exit surface of a primary lens for the LED module according to the invention.
Figure 6:
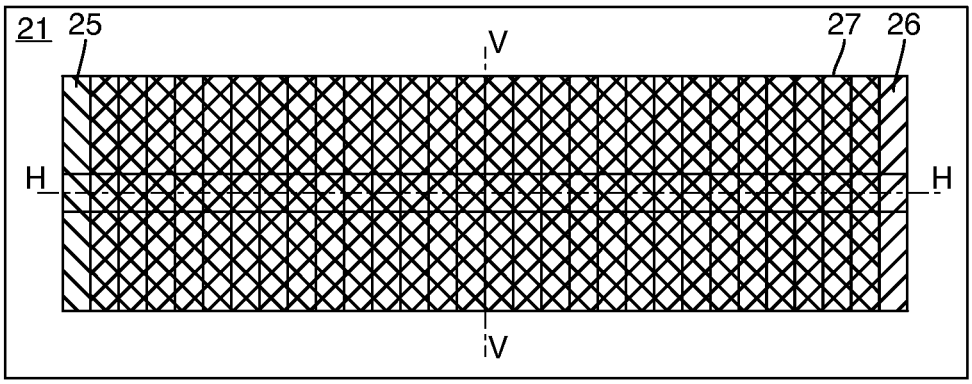
FIG. 6 shows a light distribution for the LED module according to the invention, resulting from a superimposing of the images in FIGS. 4 and 5.

A first image 25 of the light exit surface 17 of the primary lens 12, which can be generated with the projection lens 16 of the present invention, is shown by way of example in FIG. 4. The image 25 in FIG. 4 is displaced in the depicted example approximately ¼ pixel to the left with respect to the vertical axis VV. A second image 26 of the light exit surface 17 of the primary lens 12 is depicted in FIG. 5. The second separate image 26 is displaced approximately ¼ pixel to the right with respect to the vertical axis VV. In this way, the first and the second image 25, 26 are offset in relation to one another by approximately ½ of a pixel. Each image 25, 26 provides one half of the joint luminous flux for the resulting overall light distribution 27, or one half of the intensity and one half of the illumination for the overall value of the light distribution 27. Because the edges of the pixels 22, 23, 24 and the pixel centers of the images 25, 26 do not lie directly on one another, the color and intensity in-homogeneities are compensated for reciprocally with the superimposing of the images 25, 26. As a result, it is possible with the present invention to generate a substantially more homogenous light distribution 27 with just one LED module 6 having a primary lens 12 and a projection lens 16, than was possible in the prior art under similar circumstances or conditions.

The intensity of the individual images 25, 26 depends on the lengths of the prism surfaces, or on the proportion of the prism base surface to which the corresponding prism surface is allocated. One embodiment of the present invention includes prisms having identical prism base surface proportions.

Figure 7:
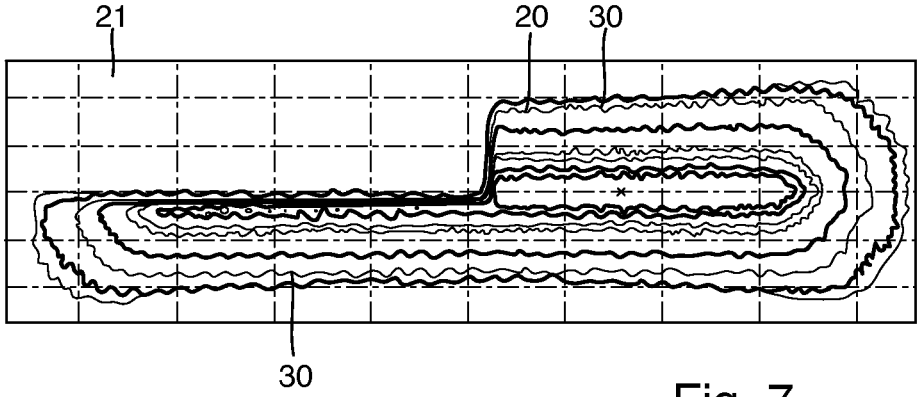
FIG. 7 shows an exemplary light distribution, with ISO lines on a measurement screen, from the LED module known from the prior art.
Figure 8:
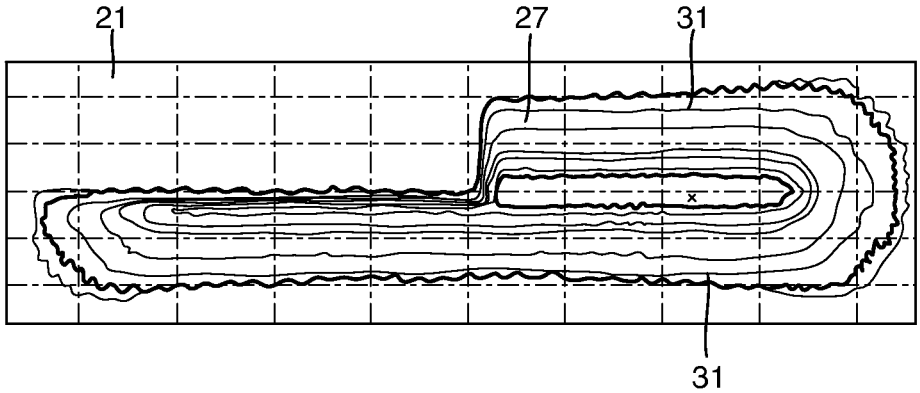
FIG. 8 shows an exemplary light distribution for an LED module according to the invention, corresponding to the light distribution from FIG. 7.

In order to illustrate the invention, reference is made to the light distributions 20, 27 shown in FIGS. 7 and 8, having ISO lines plotted therein (isolux lines for indicating regions having identical illumination values). In FIG. 7, the light distribution 20 that would be generated with a conventional LED module is shown. The depicted light distribution 20 concerns a low beam light distribution, or a partial high beam, wherein the entire region of the traffic lane for oncoming traffic is removed from the light distribution 20, in order to prevent blinding oncoming traffic. The light distribution 20 is imaged on a measurement screen 21. As shown, the lines 30 with identical intensity or illumination values exhibit in-homogeneities, which is indicated by the uneven courses of the lines. In contrast thereto, the lines 31 having identical intensities or illumination values in the light distribution 27 generated with the matrix headlamp 1 according to the invention, or the LED module 6 according to the invention, respectively, exhibit significantly fewer in-homogeneities, as is indicated by the significantly more even courses of the lines.

FIGS. 7 and 8 show by way of example the same low beam pattern 20, 27 of a matrix headlamp 1 having an LED matrix light source 10 with three rows. All LED chips 11 of the LED matrix 10 that generate pixels in the upper and lower rows on the left side of the light distribution 20, 27, plus one pixel, respectively, on the right side of the light distribution 20, 27 adjacent to the HV point, are switched off, in order to not blind the oncoming traffic. The ISO lines 30 in FIG. 7 are significantly more uneven. The ISO lines 31 for the light distribution 27 in FIG. 8, in contrast, are more even and have fewer fluctuations.

Figure 9:
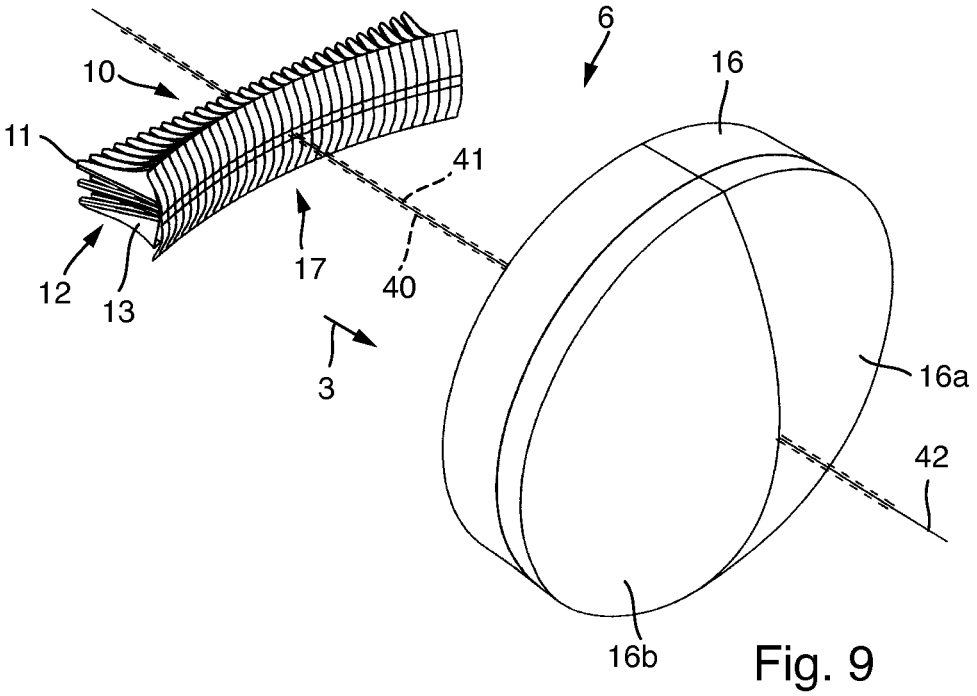
FIG. 9 shows a projection lens according to the invention, having parallel optical axes.

An LED module 6 according to the invention, having a projection lens 16 according to the invention, is shown in detail in FIG. 9. Here, the projection lens 16 serves for generating two separate images 25, 26 of the light exit surface 17 of the primary lens 12. It will be appreciated that the projection lens 16 can also be designed so as to generate more than two separate images, displaced in relation to one another in the horizontal direction. The projection lens 16 has two parallel optical axes, indicated by the reference numerals 40 and 41. The reference numeral 42 indicates a module axis of the LED module 6, which runs from the middle of the primary lens 12 in the direction of travel 3. The spacing between the optical axes 40, 41 is small and only large enough that the projection lens 16 can project two separate images 25, 26 at a ½ pixel spacing onto the road surface in front of the motor vehicle. The optical axes 40, 41 are preferably disposed on a common horizontal plane, which may also include the module axis 42. In the depicted embodiment, the projection lens 16 is divided into two halves 16*a*, 16*b* along a vertical central plane, which includes the module axis 42. The one half 16*a* is preferably allocated to the optical axis 41 and the other half 16*b* is preferably allocated to the optical axis 40.

It is not necessary that all of the active optical surfaces of the projection lens 16 are subjected to a division and/or displacement of the generated surfaces. It is sufficient if only one of these surfaces is formed in this way. This can be, for example, a light entry surface, a light exit surface, or a surface of the primary lens 16 disposed therebetween. At least one of the active optical surfaces of the projection lens 16, however, should be modified such that the at least two images 25, 26 of the light exit surface 17 of the primary lens 12 can be generated, which are offset to one another in the horizontal direction.

Figure 10:
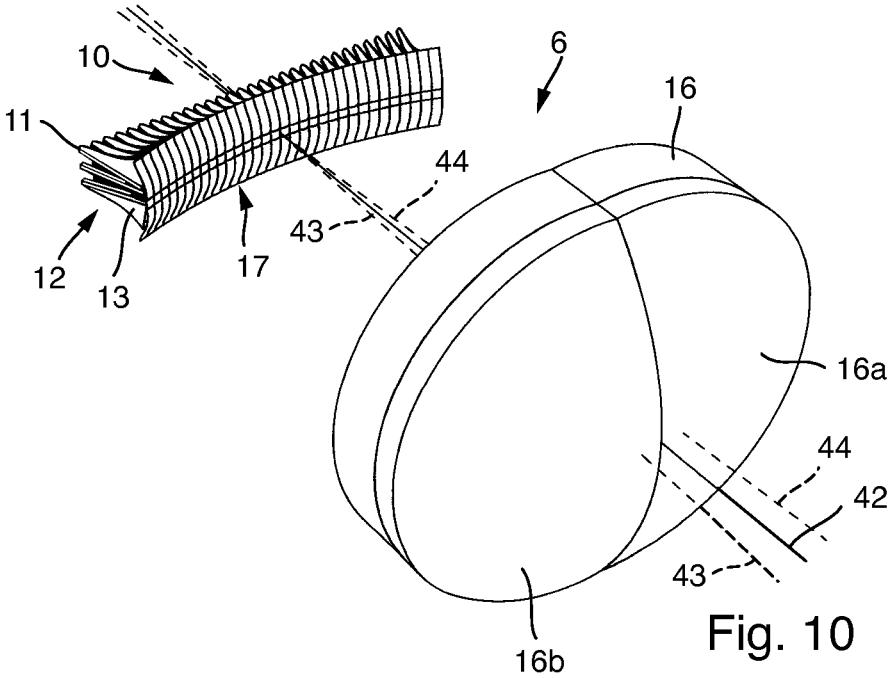
FIG. 10 shows a projection lens according to the invention, have angled optical axes.

Another embodiment of an LED module 6 according to the invention, having two optical axes 43, 44 running at an angle to one another, is shown in FIG. 10. Preferably, the optical axes 43, 44 intersect in a plane of the light exit surface 17 of the primary lens 12. The optical axes 43, 44 are preferably also disposed on a common horizontal plane, which preferably also includes the module axis 42. In the depicted embodiment, a first half 16*a* of the projection lens 16 is allocated to the optical axis 44 and a second half 16*b* of the projection lens 16 is allocated to the optical axis 43.

Figure 11:
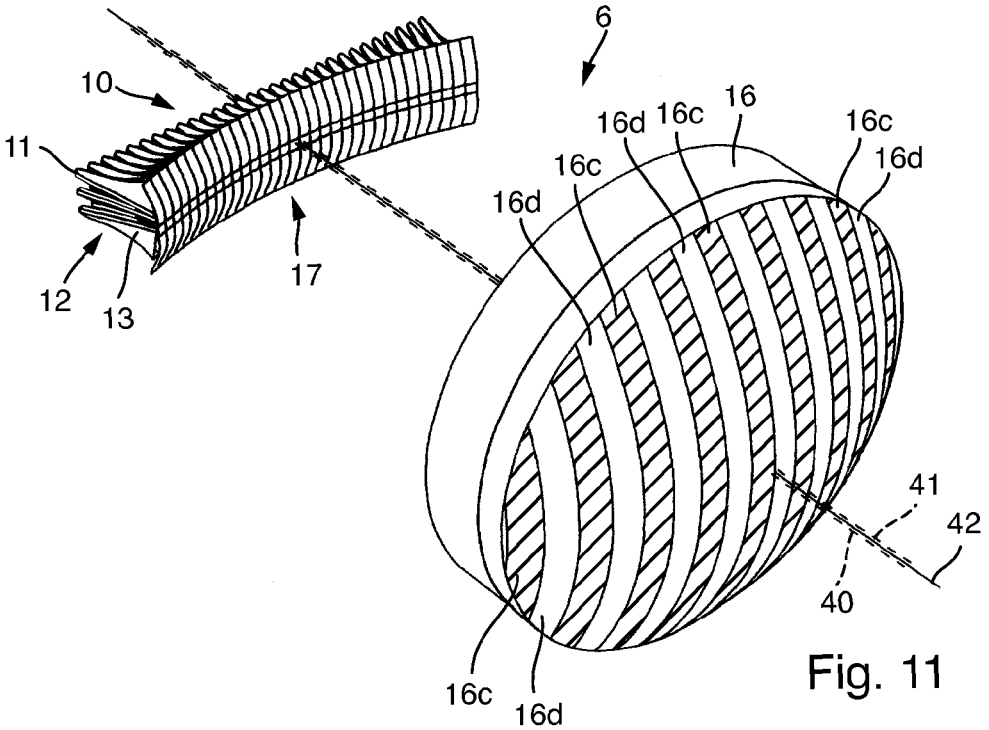
FIG. 11 shows a projection lens according to the invention, having alternating optically effective regions on the light exit surface.

Another preferred embodiment of the projection lens 16 according to the invention is based on a special structure on one of the active optical surfaces of the projection lens 16. A corresponding embodiment is shown in FIG. 11, wherein alternating optical regions 16*c*, 16*d* disposed adjacent to one another are formed on the light exit surface of the projection lens 16. In the depicted embodiment example, the regions 16*c*, 16*d* are disposed in the shape of strips on the light exit surface of the projection lens 16. As a matter of course, the regions can also be designed as a checkerboard, or in any other way. Moreover, it is conceivable that the optical regions 16*c*, 16*d* are formed, not on the light exit surface, but rather on the light entry surface or any other surface between the light entry surface and the light exit surface of the projection lens 16. The optical regions 16*c*, 16*d* are designed for generating substantially identical images 25, 26 of the exit surface 17 of the primary lens 12. In doing so, all of the regions 16*c* collectively generate a first image of the light exit surface 17, and all of the regions 16*d* collectively generate a second image 26 of the exit surface 17. The first optical regions 16*c* are preferably allocated to the first optical axis 40 and the second optical regions 16*d* are preferably allocated to the second optical axis 41. A projection lens 16 can also be implemented in this way, which can generate numerous separate images 25, 26 of the light exit surface 17 of the primary lens 12, which are displaced in relation to one another in the horizontal direction. With the embodiment example from FIG. 11, the first optical regions 16*c* form a first group, which generates the first image 25 of the exit surface 17, and the second regions 16*d* form a second group, which generates the second image 26 of the exit surface 17 of the primary lens 12.

In FIG. 11, the first regions 16*c* are indicated by a cross-hatching. This serves, primarily, to identify and better distinguish the two regions 16*c*, 16*d* from one another. This does not necessarily mean that an optically effective structure, such as a diffusion structure, is formed on the light exit surface of the projection lens 16 in the regions 16*c*, while in contrast no such structure is formed in the regions 16*d*. This would be entirely possible, however. Likewise, it would be conceivable to provide a diffusion structure on the entire light exit surface of the projection lens 16.

Figure 12:
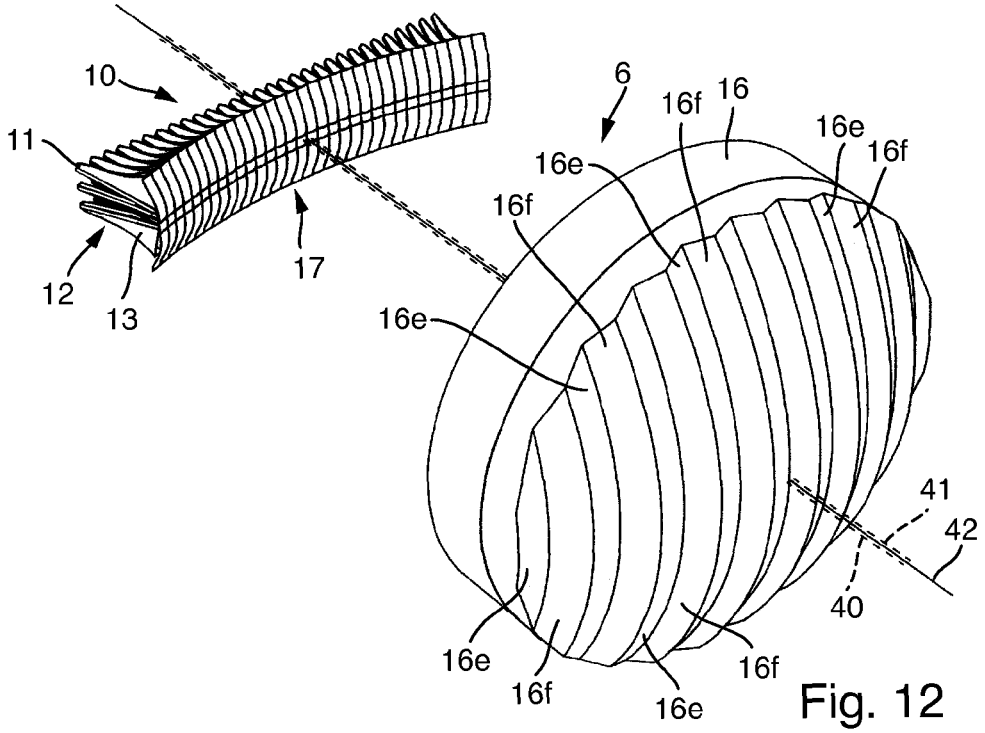
FIG. 12 shows a projection lens according to the invention, having a prism structure on the light exit surface.

Another embodiment example of an LED module 6 according to the invention, or a projection lens 16, respectively, is shown in FIG. 12. In this case, an active optical surface of the projection lens 16, the light exit surface in the depicted embodiment example, is provided with numerous prisms, extending over the entire surface, disposed adjacent to one another, the longitudinal axes of which run parallel to one another in the vertical direction. A first prism surface 16*e* of the prisms generates a first image 25 of the exit surface 17 of the primary lens 12. Another prism surface 16*f* of the prisms generates a second image 26 of the exit surface 17 of the primary lens 12. Thus, a respective first prism surface 16*e*, together with a second prism surface 16*f*, forms one of the prisms on the light exit surface of the projection lens 16. Preferably the first prism surfaces 16*e* are allocated to the first optical axis 41, and the other prism surfaces 16*f* are allocated to the second optical axis 42. In this way, separate images 25, 26 of the exit surface 17 of the primary lens 12 are generated, which are offset to one another in the horizontal direction.

The amplitudes of the prism structure on the light exit surface of the projection lens 16 in FIG. 12 are relatively small, such that they are difficult to detect with the naked eye. In particular, the amplitudes are conceived on a scale of a few micrometers to a few tens of micrometers. The structures are thus at best perceived by an observer seeing the headlamp 1 through the cover plate 5 from the outside as lightly indicated strips, or alternatively, as a relatively inconspicuous checkerboard pattern on the projection lens 16.

Figure 13A:
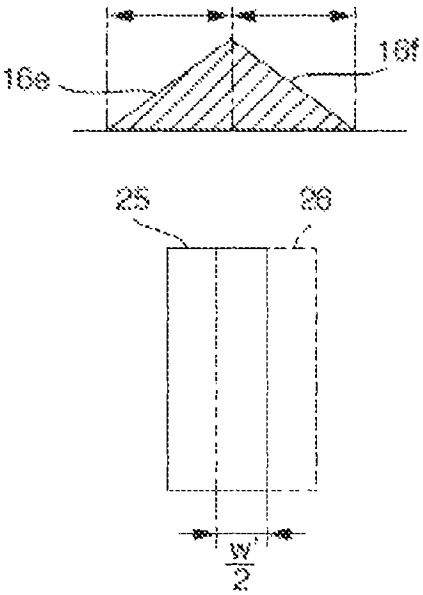
FIGS. 13A-13C show examples of structures on an optically active surface of a projection lens according to the invention.
Figure 13B:
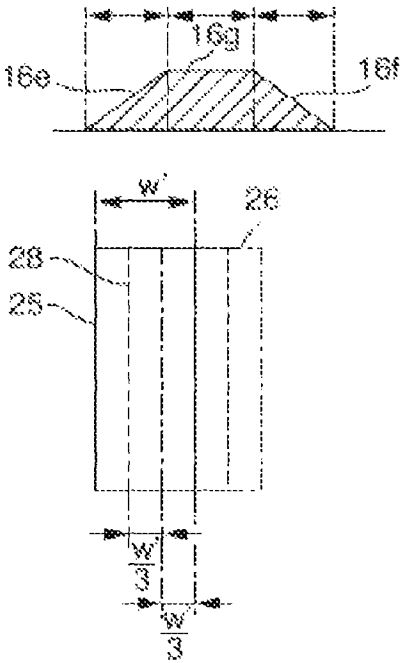
Figure 13C:
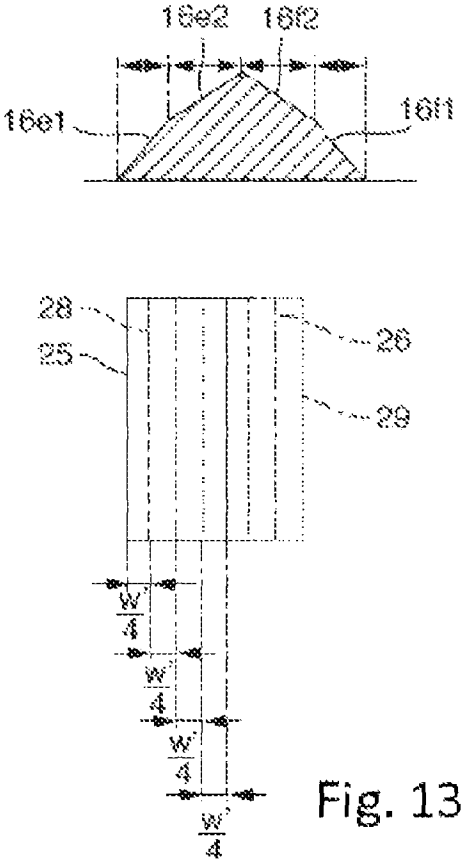

Different design possibilities for the prism structure on the optically active surface of the projection lens 16 are proposed in FIGS. 13A-13C, wherein each Figure shows a cross-section cut through one of the prisms, in each case, at the top, and beneath this, the images of the light exit surface 17 of the primary lens 12 that can be obtained with the illustrated prism structure, are depicted.

The prism structure in FIG. 13A corresponds to the prism structure that is used in the embodiment example of the projection lens 16 from FIG. 12. The images 25 and 26 that can be obtained thereby are offset to one another by ½ of a pixel width w'. With the embodiment example in FIG. 13B, an apex of the prisms 16*e*, 16*f* is flattened off over the entire length, such that a roof surface 16*g* of the prisms is obtained, which generates a further image 28 of the light exit surface 17 of the primary lens 12, which is offset in the horizontal direction in relation to the other two images 25, 26, which are generated by the prism surfaces 16*e*, 16*f*. The three images 25, 26, 28 are preferably offset in relation to one another in the horizontal direction by ⅓ of a pixel width w'. In order to obtain the desired distribution at ⅓ of the pixel or strip width w', the prism angle α should be adapted accordingly. The surface 16*g* generates an image 28 in the center of the light distribution. With the embodiment in FIG. 13C, the prism surfaces 16*e*, 16*f* of the prisms are each divided into two sub-surfaces 16*e*1, 16*e*2; 16*f*1, 16*f*2 over their entire lengths. In doing so, a contact line of the sub-surfaces 16*e*1, 16*e*2; 16*f*1, 16*f*2 of a prism surface 16*e*; 16*f* of a prism runs parallel to a longitudinal axis of the prism. The sub-surfaces 16*e*1, 16*e*2; 16*f*1, 16*f*2 of a prism surface 16*e*; 16*f* generate two separate images 25, 28; 26, 29, disposed offset to one another, which are also offset in relation to the other images 26, 29; 25, 28. In particular, it is proposed that the four images 25, 26, 28, 29 of the light exit surface 17 of the primary lens 12 are each offset in relation to one another by ¼ of a pixel width w'.

It is conceivable to generate more than four images of the light exit surface 17 of the primary lens 12 with other designs for the prism structure. As such, it is conceivable, for example, that with the prism structure from FIG. 13C, the apexes of the prisms are flattened off over their entire lengths, such that a roof surface, similar to the roof surface 16*c* of the prism structure from FIG. 13B is obtained, which generates a further image of the light exit surface 17 of the primary lens 12.

Figure 14A:
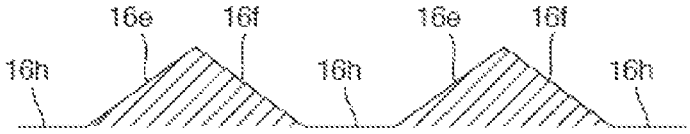
FIGS. 14A-14C show further examples of structures on an optically active surface of a projection lens according to the invention.
Figure 14B:
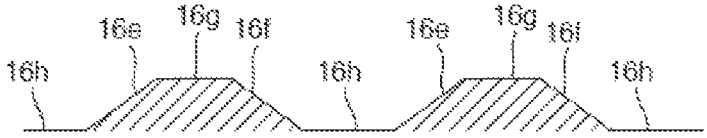
Figure 14C:
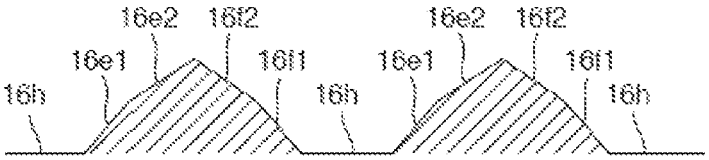

Further possible designs for the prism structure on the optically active surface of the projection lens 16 are depicted in FIGS. 14A-14C. The actual prisms in FIGS. 14A, 14B, 14C correspond substantially to the prisms in FIGS. 13A, 13B 13C. With the embodiment example from FIGS. 14A-14C, however, straight sections 16*h* are provided between the individual prisms 16*e*, 16*f*. Thus, it is possible, with the prism structure from FIG. 14A, to generate a total of two, plus one, thus three, separate images of the light exit surface 17 of the primary lens 12. Likewise, with the prism structure according to FIG. 14B it is possible to generate a total of two, plus two, thus four, separate images. The strips 16*g* and 16*h* can generate identical images, because the optical axes are not angled toward one another, and as a result, the images coincide. In a corresponding way, with the prism structure in FIG. 14C, four plus one, thus five, images of the light exit surface 17 of the primary lens 12 can be generated.

Figure 15:
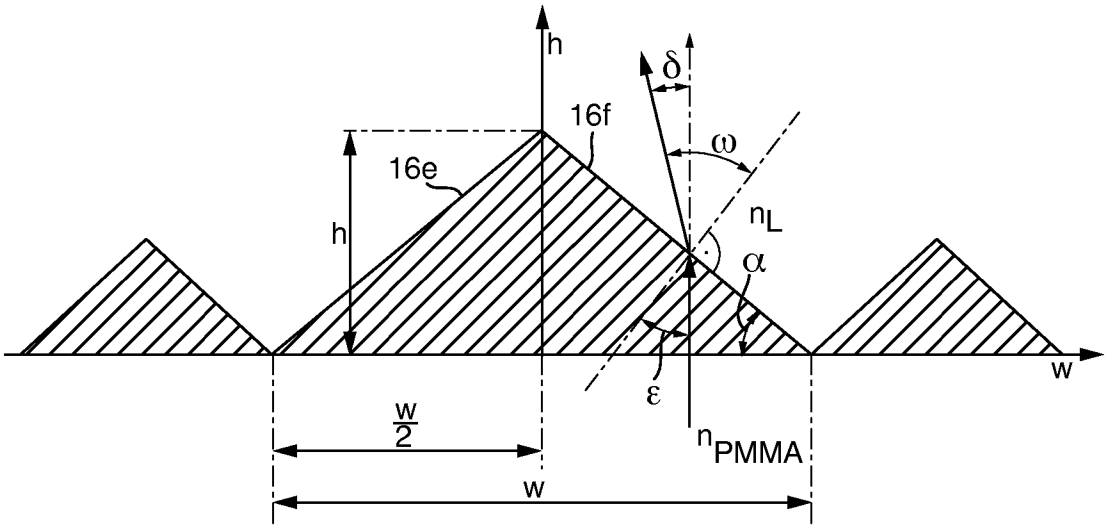
FIG. 15 shows detail of a prism structure on an optically active surface of a projection lens according to the invention.
Figure 16:
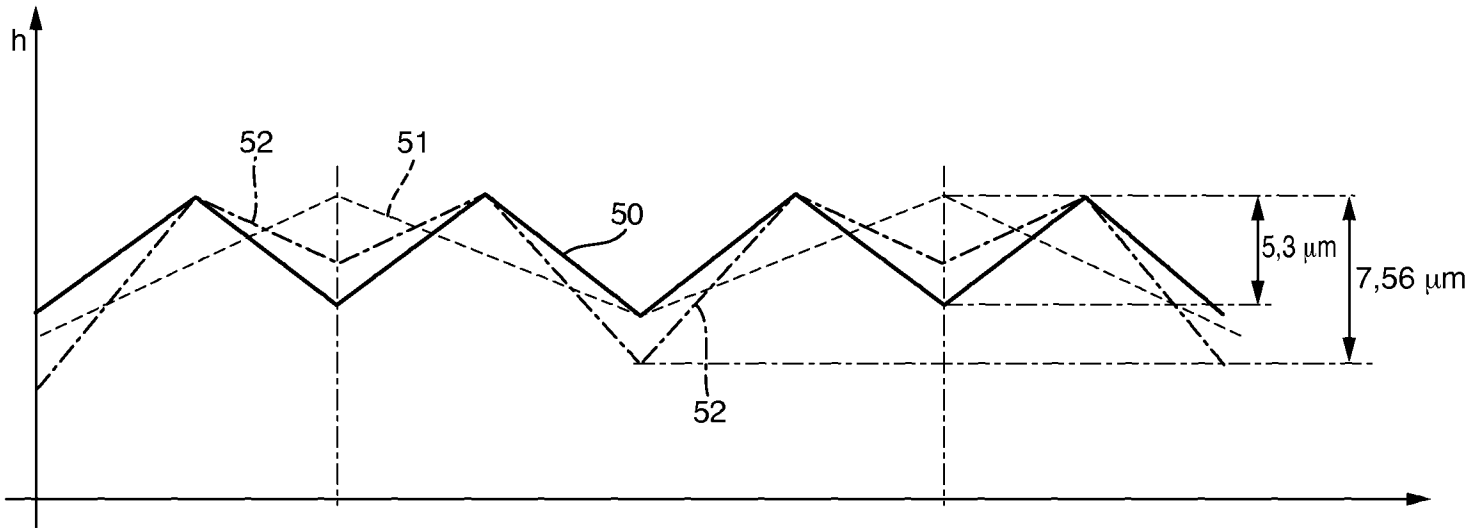
FIG. 16 shows further examples of structures on an optically active surface of a projection lens according to the invention.

Based on the FIGS. 15 and 16, as explained below, the height of the prism structure for a projection lens 16 according to the invention can be calculated. To that end, in FIG. 15, the prism structure according to FIGS. 12 and 13A will serve as a basis. In FIG. 15:

- h: height of the prisms in millimeters
- w: wavelength (one period) of the prism structure (or a base width of a prism) in millimeters
- ϵ: light incidence angle in relation to a surface norm for the prism surface 16*f*
- ω: light decoupling angle in relation to the surface norm for the prism surface 16*f*
- δ: ω−ϵ=the difference in angles between incident light beams and decoupled light beams
- α: prism angle in relation to a vertical, or an angle of a prism surface 16*e*, 16*f* in relation to a vertical surface
- ϕ: pixel width in angular degrees The following relationship applies to the prism structure in FIG. 15:

$$\tan \alpha = \frac{h}{\frac{w}{2}} = \frac{2h}{w} \tag{1}$$

Furthermore, Snell's law applies:

$$\frac{\sin\varepsilon}{\sin\omega} = \frac{n_L}{n_{PMMA}} \tag{2}$$

From which, according to the conversion, and with $n_L=1$ for air, the following is obtained:

$$\sin \omega = n_{PMMA} \cdot \sin \epsilon \tag{2'}$$

Thus, for ω:

$$\omega = \arcsin(n_{PMMA} \cdot \sin \epsilon) \tag{3}$$

And furthermore:

$$\delta = \omega - \varepsilon = \arcsin(n_{PMMA} \cdot \sin\varepsilon) - \varepsilon \overset{!}{=} \frac{1}{4}\frac{\varphi}{\text{Pixel width}[°]} \tag{4}$$

The angular difference thus needs to be ±¼ of a pixel width for two separate images 25, 26 of the light exit surface 17 of the primary lens 12, in order that the two images 25, 26 are offset to one another by ½ of a pixel width. Thus, from equation (4):

$$\arcsin(n_{PMMA} \cdot \sin\varepsilon) = \frac{\varphi}{4} + \varepsilon \tag{5}$$

and after conversion:

$$n_{PMMA} \cdot \sin\varepsilon = \sin\left(\frac{\varphi}{4} + \varepsilon\right) \tag{6}$$

or:

-continued $$n_{PMMA} \cdot \sin\varepsilon = \sin\frac{\varphi}{4} \cdot \cos\varepsilon + \cos\frac{\varphi}{4} \cdot \sin\varepsilon \tag{7}$$

and:

$$\left(n_{PMMA} - \cos\frac{\varphi}{4}\right) \cdot \sin\varepsilon = \sin\frac{\varphi}{4} \cdot \cos\varepsilon \tag{8}$$

from which the following is obtained $$\tan\varepsilon = \frac{\sin\frac{\varphi}{4}}{n_{PMMA} - \cos\frac{\varphi}{4}} \tag{9}$$

or:

$$\varepsilon = \arctan\left(\frac{\sin\frac{\varphi}{4}}{n_{PMMA} - \cos\frac{\varphi}{4}}\right) \tag{10}$$

for $\alpha=\epsilon$:

$$\varepsilon = \arctan\left(\frac{h}{\frac{w}{2}}\right) = \arctan\left(\frac{2h}{w}\right) \tag{11}$$

From the equations (10) and (11):

$$\frac{2h}{w} = \frac{\sin\frac{\varphi}{4}}{n_{PMMA} - \cos\frac{\varphi}{4}} \tag{12}$$

Thus, for ½ pixel offsetting, the necessary prism height h is:

$$h_{\frac{1}{2}\,pixel\,offsetting} = \frac{w}{2} \cdot \frac{\sin\frac{\varphi}{4}}{n_{PMMA} - \cos\frac{\varphi}{4}} \tag{13}$$

With a ½ pixel offsetting, the images 25, 26 are shifted in relation to one another by $\phi/2$ ($\pm\phi/4$). This relates to a so-called compensation of the first order. For a compensation of the second order, two double imaging groups need to be offset in relation to one another. In the following, it is explained how one can determine the height h of the prism for a compensation of the second order:

$$h_{\frac{1}{4}\,Pixel\,offsetting} = Pixel\,offsetting\ \ von\ \ \frac{\varphi}{4} = +/-\frac{\varphi}{8}$$

Thus, for the pixel height h:

$$h_{\frac{1}{4}\,Pixel\,offsetting} = \frac{2w}{2}\frac{\sin\frac{\varphi}{2}}{n_{PMMA} - \cos\frac{\varphi}{2}} \tag{14}$$

With very small angles, the following applies:

$$\sin\vartheta = \vartheta\ und\ \sin\frac{\vartheta}{2} = \frac{\vartheta}{2}\ und\ \sin\frac{\varphi}{8} = \frac{1}{2}\sin\frac{\varphi}{4}$$

$$\cos\frac{\varphi}{4} \approx \cos\frac{\varphi}{8} \approx 1$$

Thus, for the compensation of the second order, the prism height h is:

$$h_{\frac{1}{4}\,Pixel\,offsetting} = \frac{2w}{2} \cdot \frac{1}{2}\frac{\sin\frac{\varphi}{4}}{n_{PMMA} - \cos\frac{\varphi}{4}} = h_{\frac{1}{2}\,Pixel\,offsetting} \tag{15}$$

Thus, for small angles, the compensation of the first order, second order, etc. needs to occur with triangular structures, which overlap, which have doubled, quadrupled, etc. wavelengths and the same amplitudes. A detail of a surface structure for an optically active surface of a projection lens 16 according to the invention is depicted in FIG. 16, by way of example. The structure of the first order is indicated thereby with a solid line 50, a structure of the second order is indicated by a broken line 51, and a sum of the two structures 50, 51 is indicated by the reference numeral 52.

The structure of the first order 50 generates two separate images 25, 26 of the light exit surface 17 of the primary lens 12, which are shifted by ½ of a pixel width in relation to one another. The prism structure of the second order 51 has a frequency of ½ (doubled period) and is frequently tilted at two of its flanks (prism surfaces) toward two adjacent flanks (one whole period) of the structure of the first order 50, and thus results in a shifting of the images in relation to one another by ¼ of a pixel width.

The prism structure 52 is the sum (resulting) from the prism structure of the first order 50 and the prism structure of the second order 51.

The amplitude h of the structure of the first order 50 relates to the necessary deflection angle of ±0.3°. With a period (wavelength w) of 2 mm and a refraction index $n_{PMMA}$=1.49, and $n_{Luft}$=1.0 [Luft: air], the prism height h is:

$$h_{\frac{1}{2}\,Pixel\,offsetting} = \frac{w}{2} \cdot \frac{\sin 0.3°\ H}{n_{PMMA} - \cos 0.3°\ H} = 10.7\ \mu m$$

The calculated prism height h=10.7 μm is relatively large. For this reason, the wavelength 2, originally 2 mm, reduced by half to 1 mm. Thus, for the amplitude h of the prism structure:

$$h_{\frac{1}{2}\,Pixel\,offsetting} = \frac{w = 1\ mm}{2} \cdot \frac{\sin 0.3°\ H}{1.49 - \cos 0.3°\ H} = 5.3\ \mu m$$

The prism structure 51 is superimposed on the prism structure of the first order 50, but should only attain one half of the deflection (½*½ pixel→±0.15° H). Thus, from the equation (14):

$$h_{\frac{1}{4}\,Pixel\,offsetting} = \frac{2w}{2}\frac{\sin 0.15°\ H}{1.49 - \cos 0.15°\ H} = 5.3\ \mu m$$

Thus, the results from the equation (15) are confirmed. The prism structure of the second order 51 has the same amplitude h as the prism structure of the first order 50. In this way, it is also fundamentally possible to generate adaptations of higher orders.

The invention has been described in an illustrative manner. It is to be understood that the terminology which has been used is intended to be in the nature of words of description rather than of limitation. Many modifications and variations of the invention are possible in light of the above teachings. Therefore, within the scope of the appended claims, the invention may be practiced other than as specifically described.

What is claimed is:

1. A projection lens for use in an LED module in a motor vehicle headlamp, wherein the LED module includes a light source in the form of an LED matrix having a plurality of LED chips disposed in a matrix adjacent to one another, a primary lens including a plurality of primary lens elements disposed in a matrix adjacent to one another for bundling light emitted from the light source, and a projection lens that projects a light exit surface of the primary lens in order to generate a predefined light distribution on a road surface in front of the vehicle, wherein the projection lens generates at least two separate images of the light exit surface of the primary lens on an image side of the projection lens, which are offset to one another in the horizontal direction, such that a superimposing of the generated images improves a homogeneity of the light distribution.

2. The projection lens as set forth in claim 1, wherein the separate images of the light exit surface of the primary lens are each offset to one another by a value of w'/n, wherein w' is a width of a pixel formed by the imaging of an individual light exit surface of a single primary lens element in the resulting light distribution, and n is the number of separate images of the light exit surface of the primary lens generated by the projection lens.

3. The projection lens as set forth in claim 1, wherein the projection lens improves the homogeneity of the light distribution with respect to a compensation for intensity fluctuations and undesired color effects in the light distribution.

4. The projection lens as set forth in claim 1, wherein the projection lens has at least two separate optical axes.

5. The projection lens as set forth in claim 4, wherein the separate optical axes of the projection lens run in the same horizontal plane.

6. The projection lens as set forth in claim 4, wherein the separate optical axes of the projection lens run parallel and at a spacing to one another.

7. The projection lens as set forth in claim 4, wherein the separate optical axes of the projection lens run at an angle to one another.

8. The projection lens as set forth in claim 7, wherein the optical axes of the projection lens intersect in a plane of the light exit surface of the primary lens.

9. The projection lens as set forth in claim 1, wherein at least one active optical surface of the projection lens is provided with alternating optical regions disposed adjacent to one another for generating substantially identical images of the exit surface of the primary lens, wherein a first group of the optical regions generates a first image of the light exit surface of the primary lens, and at least one further group of the optical regions generates at least one further image of the exit surface of the primary lens, wherein the generated images are disposed offset to one another in the horizontal direction in the resulting light distribution.

10. The projection lens as set forth in claim 9, wherein the alternating optical regions are formed on a light exit surface of the projection lens.

11. The projection lens as set forth in claim 9, wherein the alternating optical regions are designed to be strip-shaped, wherein the strips extend in the vertical direction.

12. The projection lens as set forth in claim 9, wherein the active optical surface of the projection lens is provided with a plurality of prisms extending over the entire surface, disposed adjacent to one another, the longitudinal axes of which run parallel to one another, wherein a prism surface of the prisms, which forms a first optical region, generates the first image of the light exit surface of the primary lens and another prism surface of the prisms, which forms a further optical region, generates the second image of the exit surface of the primary lens.

13. The projection lens as set forth in claim 12, wherein an apex of the prisms is flattened off over its entire length, such that a roof surface of the prisms is obtained, which generates a further image of the light exit surface of the primary lens, which is offset to the other two images in the horizontal direction.

14. The projection lens as set forth in claim 12, wherein the prism surfaces of the prisms are each divided into two sub-surfaces over their entire length, wherein a contact line of the sub-surfaces of a prism surface of a prism runs parallel to the longitudinal axis of the prism, wherein the sub-surfaces each generate a separate image of the light exit surface of the primary lens, disposed offset to the other images.

15. The projection lens as set forth in claim 9, wherein the alternating regions formed on the at least one active optical surface of the projection lens have an amplitude of less than 0.1 mm.

16. An LED module for a motor vehicle headlamp, wherein the LED module includes a light source in the form of an LED matrix having a plurality of LED chips disposed in a matrix adjacent to one another, a primary lens including a plurality of primary lens elements disposed in a matrix adjacent to one another for bundling light emitted from the light source, and a projection lens that projects a light exit surface of the primary lens in order to generate a predefined light distribution on a road surface in front of the vehicle, wherein the projection lens generates at least two separate images of the light exit surface of the primary lens on an image side of the projection lens, which are offset to one another in the horizontal direction, such that a superimposing of the generated images improves a homogeneity of the light distribution.

17. A motor vehicle headlamp having an LED module that includes a light source in the form of an LED matrix having a plurality of LED chips disposed in a matrix adjacent to one another, a primary lens including a plurality of primary lens elements disposed in a matrix adjacent to one another for bundling light emitted from the light source, and a projection lens that projects an exit surface of the primary lens in order to generate a predefined light distribution on a road surface in front of the vehicle, wherein the projection lens generates at least two separate images of the exit surface of the primary lens on an image side of the projection lens, which are offset to one another in the horizontal direction, such that a superimposing of the generated images improves a homogeneity of the light distribution.

* * * * *